US005799402A

United States Patent [19]

De Blois

[11] Patent Number: 5,799,402

[45] Date of Patent: Sep. 1, 1998

[54] PORTABLE DEVICE FOR REMOVABLY POSITIONING AND RESETTING VANISHING POINTS OF PERSPECTIVE DRAWINGS

[76] Inventor: Jacques De Blois, 30, du Pommier, St-Ferréol-les-Neiges, Quebec, Canada, G0A 3R0

[21] Appl. No.: 667,385

[22] Filed: Jun. 21, 1996

Related U.S. Application Data

[63] Continuation-in-part of Ser. No. 243,691, May 17, 1994, abandoned.

[51] Int. Cl.[6] ..... B43L 13/14

[52] U.S. Cl. ..... 33/1 K; 33/432

[58] Field of Search ..... 33/1 K, 1 CC, 33/18.3, 20.3, 274, 430, 432, 434, 433, 516

[56] References Cited

U.S. PATENT DOCUMENTS

| | | | |
|---|---|---|---|
| 26,495 | 4/1859 | Rosquist . | |
| 145,452 | 1/1873 | Pocklington . | |
| 497,147 | 5/1893 | Urich | 33/432 |
| 668,957 | 2/1901 | Fletcher | 33/430 |
| 795,065 | 7/1905 | Ring | 33/434 |
| 1,986,625 | 1/1935 | De Lorenzi . | |
| 2,667,694 | 2/1954 | McQuaid et al. | 33/432 |
| 2,669,025 | 2/1954 | Hysing . | |
| 2,936,524 | 5/1960 | Shaffer | 33/430 |
| 2,965,968 | 12/1960 | Knauer | 33/430 |
| 3,107,430 | 10/1963 | Weeks . | |
| 3,389,470 | 6/1968 | Johnson | 33/434 |
| 3,503,129 | 3/1970 | Saxton . | |
| 3,678,589 | 7/1972 | Baier | 33/277 |
| 3,719,995 | 3/1973 | Sauvageau | 33/433 |
| 3,826,007 | 7/1974 | Senshu et al. . | |
| 3,872,597 | 3/1975 | TEnnant . | |
| 3,978,587 | 9/1976 | Baugh | 33/433 |
| 4,075,762 | 2/1978 | Ohtake . | |
| 4,159,571 | 7/1979 | Jervis, Jr. . | |
| 4,245,394 | 1/1981 | Peterson . | |
| 4,360,975 | 11/1982 | Wurtz . | |
| 4,453,318 | 6/1984 | Hayes | 33/432 |
| 4,558,522 | 12/1985 | Lance | 33/443 |
| 4,688,334 | 8/1987 | Tsou | 33/1 K |

FOREIGN PATENT DOCUMENTS

| | | | |
|---|---|---|---|
| 81588 | 10/1920 | Austria | 33/20.3 |
| 255671 | 11/1925 | Canada . | |
| 512607 | 5/1955 | Canada . | |
| 543511 | 7/1957 | Canada . | |
| 870718 | 5/1971 | Canada . | |
| 931346 | 8/1973 | Canada . | |
| 376843 | 4/1921 | Germany | 33/430 |

*Primary Examiner*—Thomas B. Will
*Attorney, Agent, or Firm*—Robic

[57] ABSTRACT

The invention relates to a portable and removable device for positioning and resetting a vanishing point of a perspective drawing which is to be construed on a support. The device comprises at least one stick of a given length and having opposite ends, one of these ends being provided with a transversal pin. The device further comprises a supporting member which can be removably fastened to the support. The supporting member further comprises a device for locking and positioning the stick to the member. The pin at the one end of the stick is positioned at a given distance from the member and used to locate the vanishing point. The device for positioning and locking the stick includes an adjustable abutment adapted to position the stick in a given direction. The abutment is able to remain in such an orientation after removal of the stick and the device for locking and positioning so as to reset the given direction of the stick. The supporting member further comprises a slanted wheel for modifying the distance of the stick from the support where the drawing is to be construed. Thanks to the slanted wheel, the stick may be prevented from contacting the drawing board which is highly desirable when the drawing surface is wet.

6 Claims, 8 Drawing Sheets

PORTABLE DEVICE FOR REMOVABLY POSITIONING AND RESETTING VANISHING POINTS OF PERSPECTIVE DRAWINGS

CROSS-REFERENCE

The present application is a continuation-in-part of application Ser. No. 08/243,691 filed May 17, 1994, now abandoned, and entitled "Portable device for positioning and storing the vanishing points of perspective drawings".

FIELD OF THE INVENTION

The present invention relates to a portable and removable device for removably positioning and resetting a vanishing point of perspective drawings on boards, panels, canvases and the like.

BACKGROUND OF THE INVENTION

Numerous devices are known in the art for use to help draftsmen in constructing perspective drawings. For example, U.S. Pat. No. 668,957 (Fletcher) describes a blackboard ruler which is secured to a support which is slidably mounted on the top of a blackboard. The blackboard ruler is pivotally mounted on the support and once pivoted in the blackboard plan, it may be secured in a desired position. A secondary ruler may be clamped to the main ruler and is provided with a least one crayon holder.

U.S. Pat. No. 497,147 (Ulrich) discloses a sliding bar which may be slid vertically through a socket and be secured in said socket by means of a thumb screw. The socket is secured to the edges of the drawing board by forks engaging the edges, and is provided with binding screws. The sliding bar is provided with a pin which projects above the upper face of the same and may indicate and reset the vanishing point.

U.S. Pat. No. 3,678,589 relates to an apparatus for drawing perspective views, including a portable case for carrying various items of sketching equipment and a top having a transparent window hinged to the box for pivotal movement between a closed position and an upright position. A sight is used to view a distant object through the window. A platform for the sight is removably mounted to the box and provided for positioning the sight at selected distance from the window in order to obtain varying degrees of perspective.

U.S. Pat. No. 3,389,470 (Johnson) relates to a drafting device for constructing perspective drawings, comprising a board. Marker guide means are disposed in juxtaposed relation on the board and are adapted to guide a suitable marking instrument on the board. An elongated substantially rigid bar having opposite ends extends outwardly from the board and includes means for individually pivotally mounting the marker guide means at the ends of the bar for swimming movement about an axis of rotation, thereby providing a variety of selectively adjusted positions on the board with the axis providing a vanishing point for the marker guide means.

The above-mentioned devices are efficient. However, when the drawing is made with a material which needs time to dry, like ink or paint, these devices may be unsuitable. Indeed, by locating the vanishing point member, one may bring the member into contact with the paintwork and cause damages to the painting. This may happen particularly when the vanishing point is located on the drawing. On the other hand, when a pencil-drawing is to be construed, it is desirable that a such contact occurs, because it makes the work easier.

SUMMARY OF THE INVENTION

Therefore, the object of the invention is to provide a portable and removable device for removably positioning and resetting a vanishing point of a perspective drawing, while having means to prevent contact with the drawing when it is desirable.

Another object of the invention is to provide a device of the aforesaid type, which is of an easy assemblage and dismantling.

A further object of the invention to provide a device as in the foregoing objects which fits on various sizes and kinds of drawing boards or panels.

In accordance with the invention, these objects and other objects of the invention that will be apparent from the following description, are achieved with a portable and removable device for positioning and resetting a vanishing point of a perspective drawing which is to be construed on a support, which comprises:

- at least one stick of a given length and having opposite ends, one of these ends being provided with a transversal pin; and
- a supporting member having in combination:
  - means for removably fastening the member on the support, said means having lateral sides; and
  - means for positioning and locking the stick to the member, the pin at the one end of the stick being positioned at a given distance from the member and use to locate the vanishing point, the means for positioning and locking the stick comprising an adjustable abutment adapted to position said stick in a given direction, the abutment being able to remain in such an orientation after removal of the stick so to reset the given direction of the stick; and
  - spacing means for modifying the distance of the stick from the support where the drawing is construed.

Preferably, the spacing means comprises a slanted wheel, which is positioned under the stick to give said stick a given angle with respect to the support. It also comprises an attaching means for removably fastening the wheel in a given position.

Preferably also, the device may further comprise:

- a second stick; and
- second means for pivotally positioning and locking the second stick and spacing means for modifying the distance of the second stick from the support where the drawing is construed, each of the positioning and locking means being provided on both sides of the means for removably fastening the member on the support.

Advantageously, the means for positioning and locking the stick comprises an element provided with a guiding groove for receiving the stick, the guiding groove defining the abutment, the element being provided with a locking vice to fasten said element to said groove in a given position.

Such an invention is particularly useful for removably positioning and resetting the vanishing point of a perspective drawing or painting while helping the user to avoid any damages to the drawing or painting caused by the sliding of the device onto the same, especially when the vanishing point is needed for completion, revision or modification of the drawings or painting.

Preferred embodiments of the present invention will now be described with reference to the accompanying drawings. However, the invention is not limited to these preferred embodiments.

DETAILED DESCRIPTION OF THE INVENTION

Figure 1:
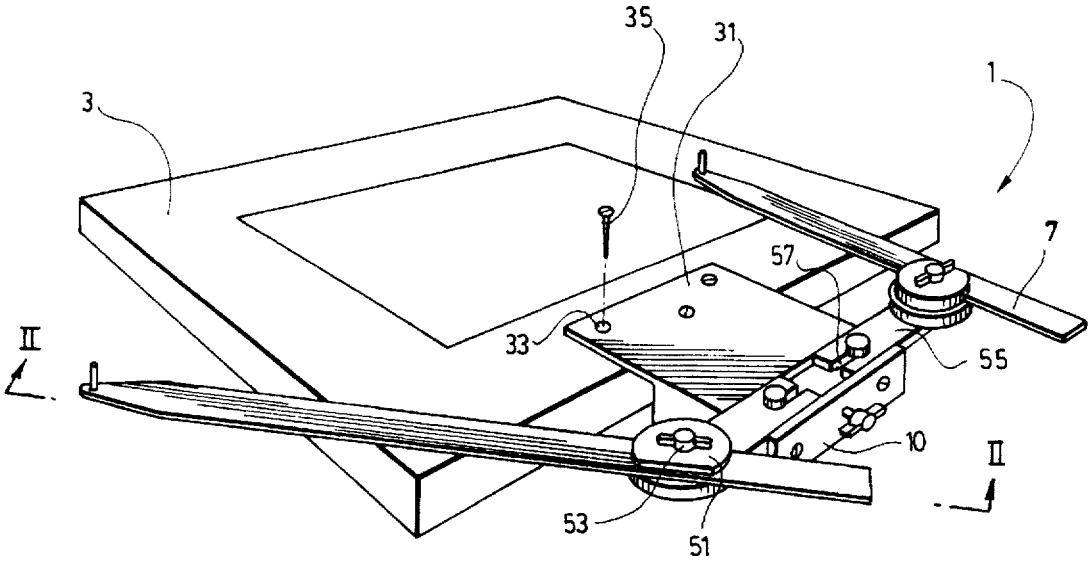
FIG. 1 is a rear perspective view of a first preferred embodiment of the invention.

For the purpose of simplicity, the same numeral references have been used through the following description and in the drawings to identify the same structural elements.

As is shown in FIGS. 1 to 15, the device 1 according to the invention for removably positioning and resetting the vanishing point of a perspective drawing, comprises a supporting member 10 having a central part. This member 10 comprises fastening means that will be described hereinafter for removably fastening the device 1 to a support 3 on which a sheet of paper, a picture or the like can be be laid down. The support 3 may be either a board, a panel or a canvas frame. Therefore, a large range of fastening means may be used depending of the kind of support used by the draftsman or the artist. The three preferred embodiments shown in the attached drawings illustrate three different fastening means for use to fasten the device 1 to a drawing board or canvas. The other parts of the device remain unchanged.

In the first embodiment of the invention shown on FIGS. 1 to 7, the fastening means is devised to fasten the supporting member 10 to a drawing board 3 on which a sheet of paper is laid over. This fastening means comprises a platform member 31 which is placed over the edges of the board 3 so as to overlap a portion of the latter. The supporting member 10 is then secured onto the board by screws 35 set into screw holes 33 provided in the platform member 31.

Figure 3:
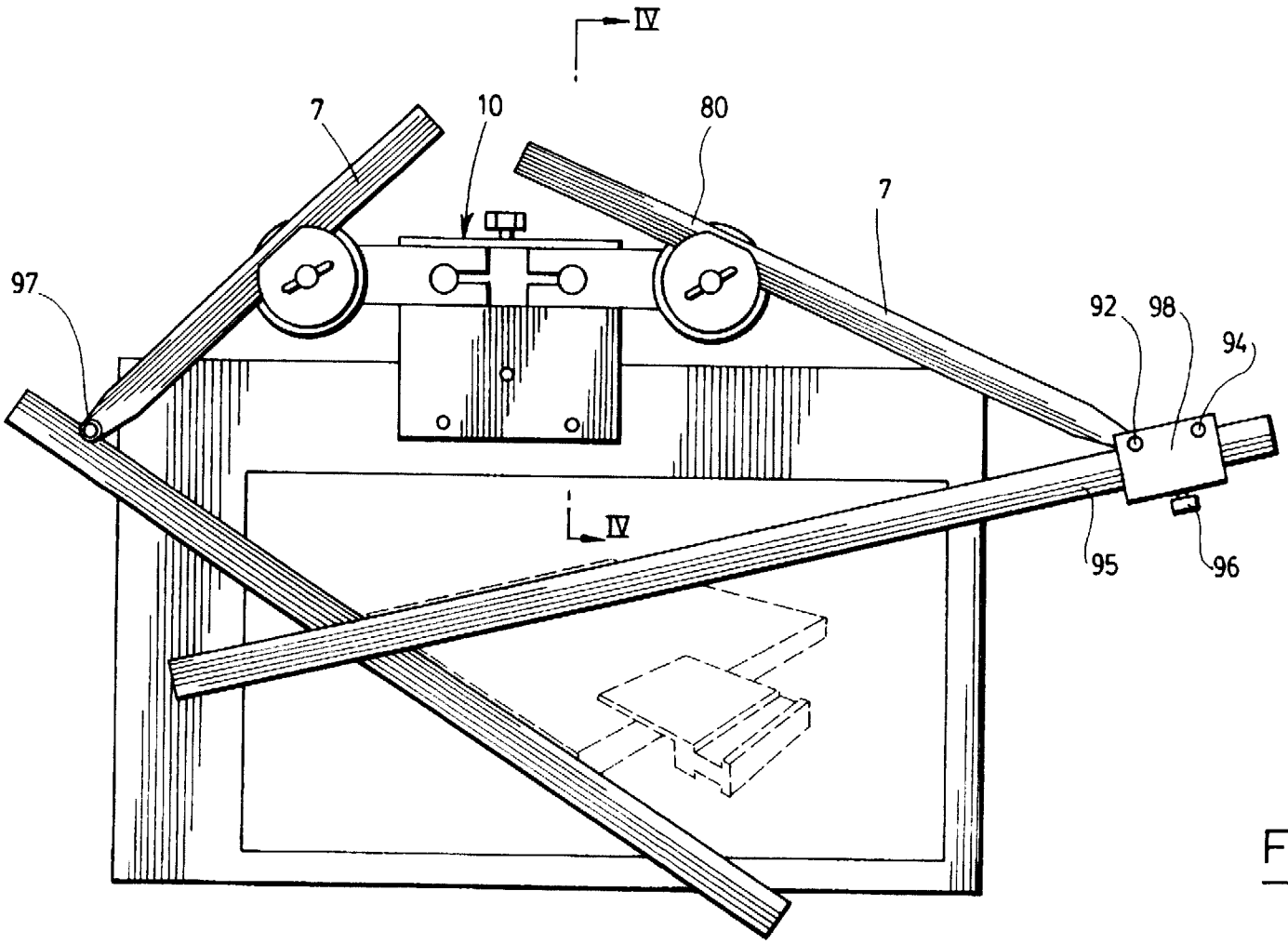
FIG. 3 is a top plan view of the device of FIG. 1, wherein a sheet is attached to the drawing board on which an "off-board" vanishing point research is to be performed, rules being provided at the end of the stick.
Figure 4:
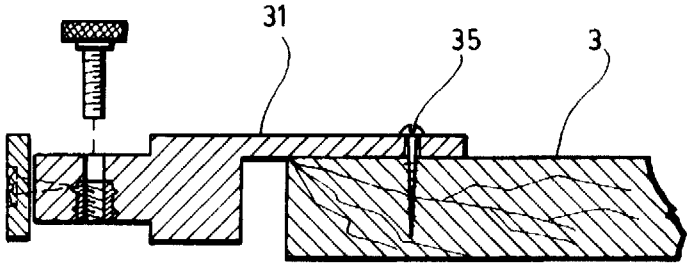
FIG. 4 is a fragmental exploded cross-sectional view of the device of FIG. 3 taken along line VI—VI.

At least one stick 7 is releasably locked to the supporting member 10 by means of a positioning and locking device 51. As shown in FIGS. 1 and 3, the device I preferably comprises two sticks 7, and two means 51 for pivotally positioning and locking each of these sticks 7. The two positioning and locking devices 51 are provided on each side of the supporting member 10, respectively.

Figure 10:
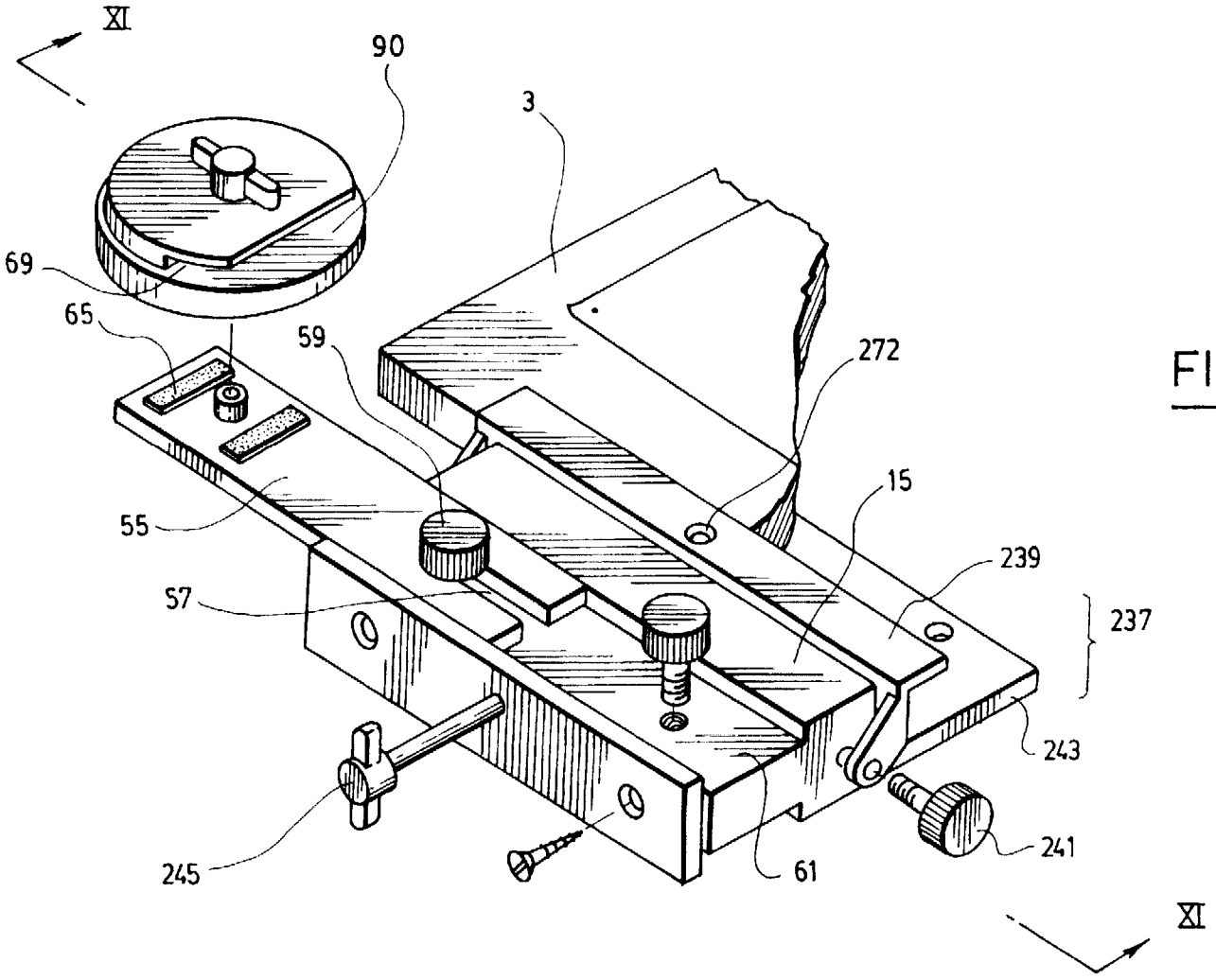
FIG. 10 is an exploded front perspective view of a part of the device of FIG. 9, showing in particular the means for pivotally positioning and locking the stick to the member.
Figure 11:
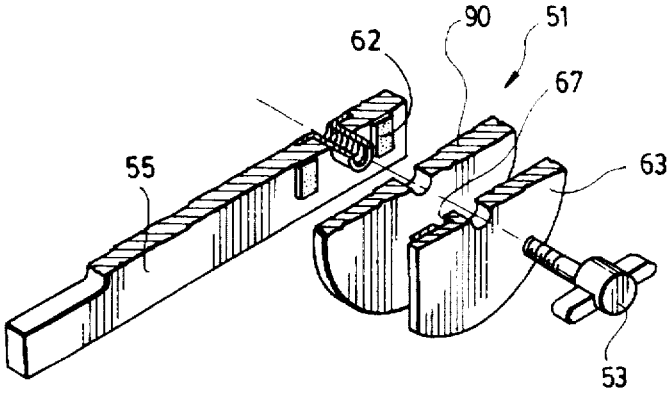
FIG. 11 is a fragmental exploded cross-sectional view of FIG. 10 taken along line XI—XI.
Figure 13:
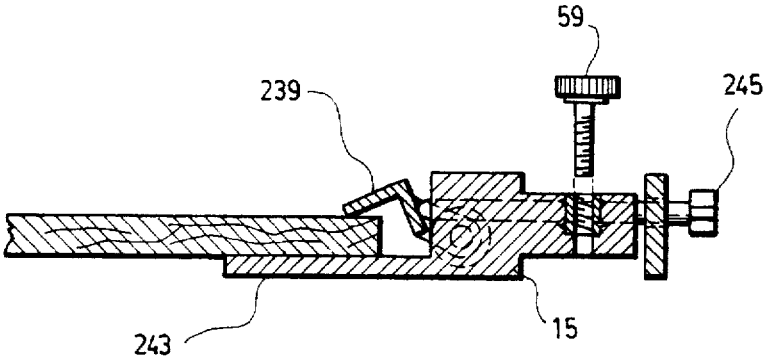
FIG. 13 is a cross sectional side view of FIG. 12 according to line XIII—XIII.
Figure 12:
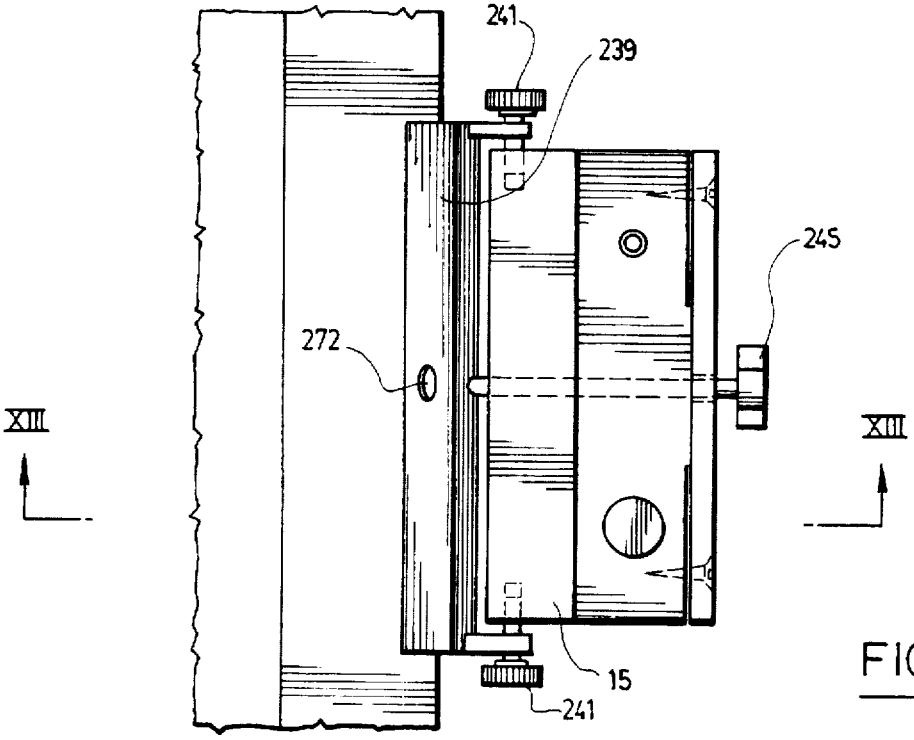
FIG. 12 is a fragmental rear view of the device of FIG. 9.

Each positioning and locking device 51 is attached by a first set screw 53 to one end of a sliding support arm 55. The sliding support arm 55 is provided with a slot 57 at its other ends. As best shown in FIGS. 10 and 11 which relate to a second embodiment of the invention, the latter differing from the first embodiment used only by the fastening means, the slot 57 engages a second set screw 59 which attaches the sliding support arm 55 to the supporting member 10. The second set screw 59 is thus used to hold in place the sliding support arm 55. Advantageously a groove 61 is provided in the fastening means to receive the sliding support element 55. The second set screw 59 is thus used to adjust the position of the sliding support arm 55 by sliding in the slot 57.

Figure 2:
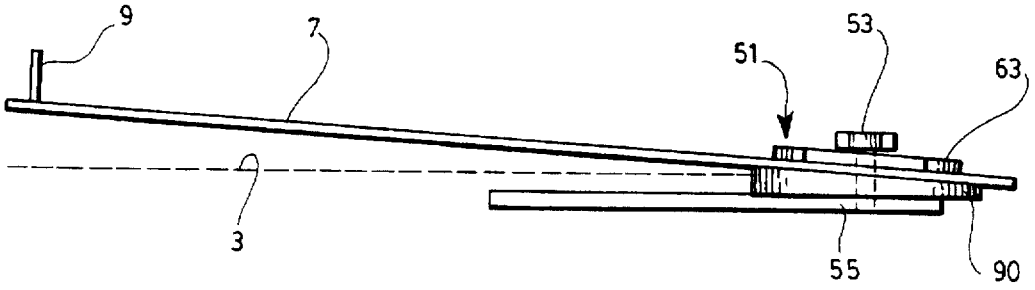
FIG. 2 is a fragmental side view of the device of FIG. 1 showing the stick mounted on its positioning wheel.
Figure 5:
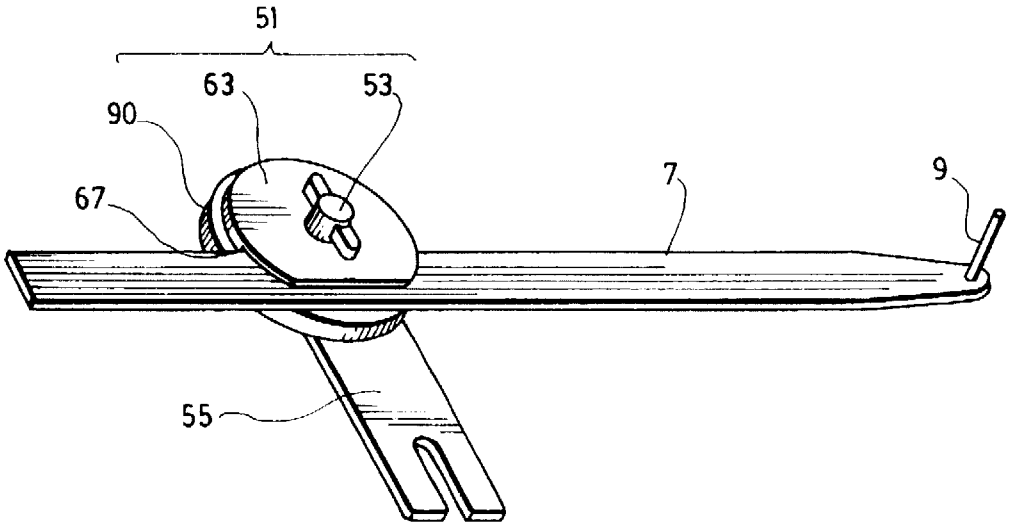
FIG. 5 is a perspective view of the stick mounted onto the means for pivotally positioning and locking it.

As best shown on FIGS. 2, 5 and 11, the positioning and locking device 51 comprises a spacing means, or slanted wheel 90, and an abutment element 63. The wheel 90 and the abutment element 63 are releasably fastened together by the first set screw 53. A resilient pad 65 (shown on FIGS. 10 and 11) may be mounted to the sliding support arm 55 to protect the elements from damages and to provide the stability to the assembly. As best shown on FIG. 2, the slanted wheel 90 permits to modify the angle at which the stick 7 extends and thus to move the latter apart from the support 3, such being very desirable when the user is working on a wet painting or drawing.

The abutment element 63 and the wheel 90 determine a groove 69 and a slender abutment 67 which may be orientated in a given direction to orientate the stick 7 in this direction when one of the end portions of the stick 7 is inserted into the groove 69 against the abutment 67 (as best shown on FIG. 5). The stick 7 is kept in position between the slanted wheel 90 and the abutment element 63 by friction pressure from the first set screw 53. Thus, the first set screw 53 is used to lock or release the stick 7 by adding or releasing pressure. The opposite end portion of the stick 7 is provided with a pin 9 acting as a vanishing point indicator.

Figure 6:
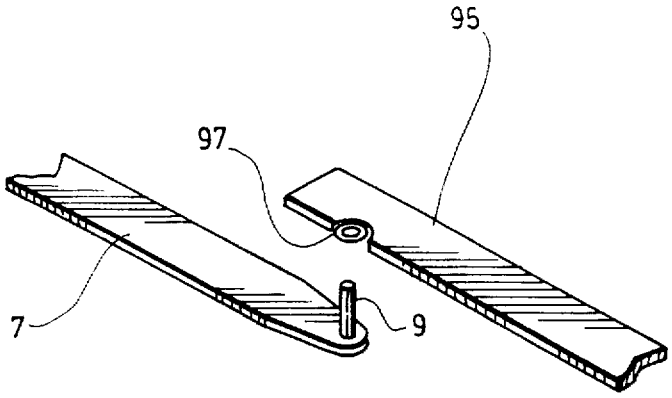
FIG. 6 is a fragmental exploded perspective view of the device of FIG. 1, showing the connection of a rule to one of the sticks by an eyelet.
Figure 7:
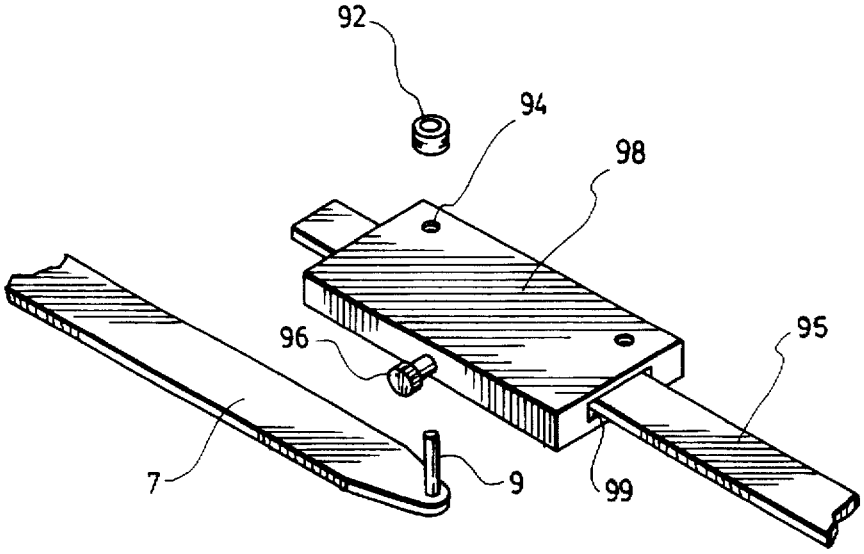
FIG. 7 is a fragmental exploded perspective view of the device of FIG. 1, showing the connection of a rule to the other stick and by a connector.

In certain cases, particularly when the vanishing point is out the area of the drawing, as shown on FIGS. 3 and 6, a rule 95 may be pivotally connected to the stick 7 by way of an eyelet 97 provided on an edge of the rule 95 and cooperating with the pin 9. To adjust the length of the rule 95, a connector 98 may be used, as shown in FIG. 3 and 7. This connector 98 has at least one transversal aperture 99 in which the rule 95 may slide. The rule 95 is fixed to a given length by a transversal locking pin 96. The connector 98 may be pivotally attached to the pin 9 by means of one of the holes 94 in which the pin 9 is engaged, and by a locking cap 92.

Figure 8:
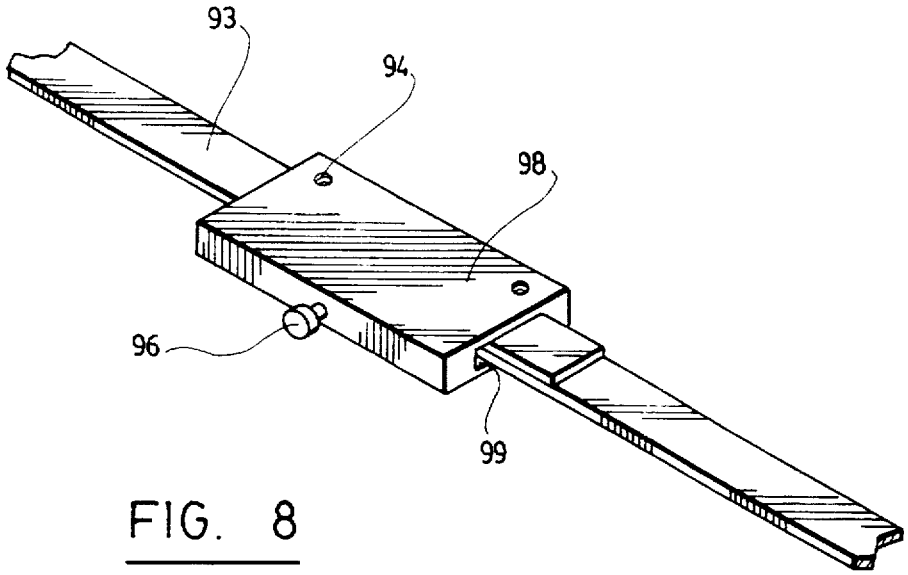
FIG. 8 is a perspective view of the connector of FIG. 7, showing it extending over the length of a stick or a rule, if needed.
Figure 9:
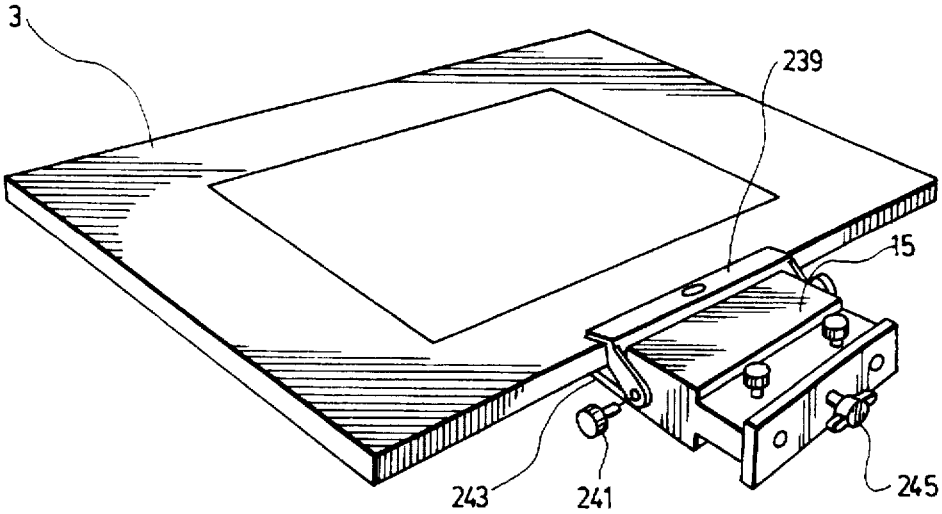
FIG. 9 is a fragmental perspective view of a second preferred embodiment of the invention wherein the fastening means is modified.

FIG. 8 shows that the connector 98 may also be used to extend either the stick 7 or the rule 95 by connecting the aforesaid element to a supplementary arm 93.

FIGS. 9 to 12 show a second preferred embodiment of the invention which differs from the previous one by its means to fasten the supporting member 10 to the support 3. In this embodiment, the fastening means comprises a pair of jaws 237 comprising a first jaw 239 pivotally attached to the central part 15 with jaw bolts or pivots 241, and a second jaw 243 which may be the platform element 31 like in the first embodiment. The first jaw 239 is wedge shaped to fit the edge of the support 3. A vice locking nut 245 is provided to act of the upper portion of the first jaw 245, as best shown on FIG. 13. This fastening means is advantageous when there is not enough place to screw the platform part 31 on the top surface of the supporting member 10, as is done in the first embodiment.

As it will appear clearly from the drawings, the fastening means may be constructed by adding the jaw 237, jaw bolts 241 and the locking nut 245 to the supporting member 10 of the first embodiment and by providing on the supporting member 10 corresponding screw holes. Such a versatility of the fastening means of the device 1 is particularly useful as it allows for a greater adaptability to various kind of drawing boards.

Figure 14:
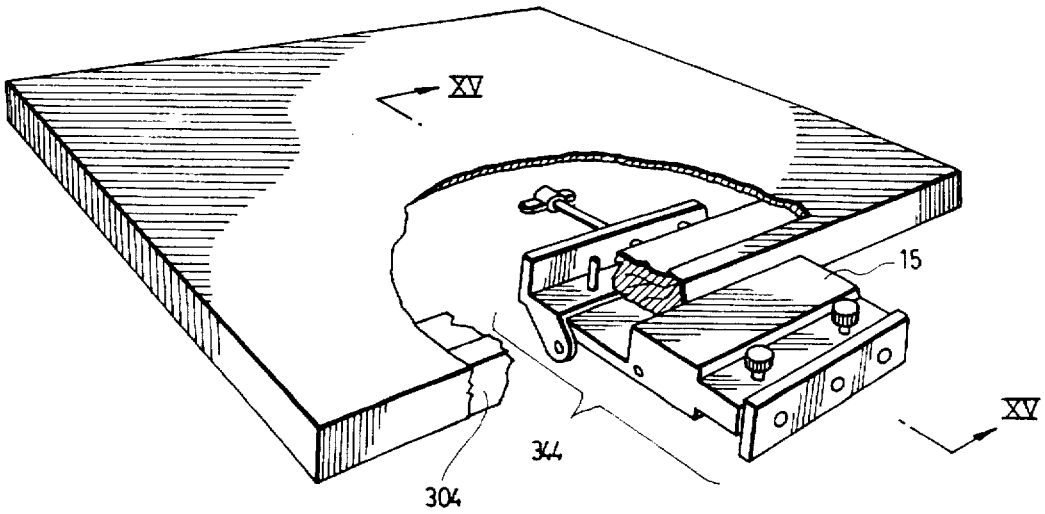
FIG. 14 is a fragmental exploded perspective view of a third preferred embodiment of the invention wherein the fastening means is modified.
Figure 15:
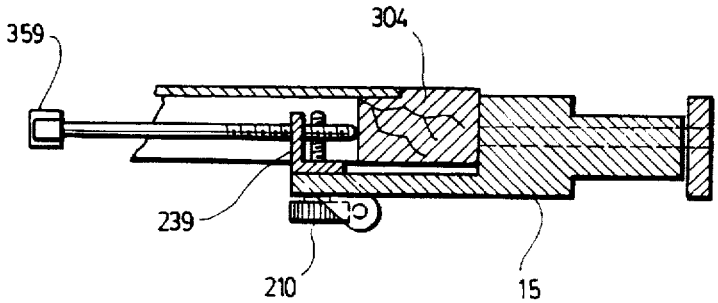
FIG. 15 is a cross sectional side view of FIG. 14 according to line XV—XV.

FIGS. 14 and 15 show a third preferred embodiment of the invention wherein the fastening member are especially designed to attach the device to a canvas frame 304. A U-shaped element 344 is provided to the central part 15 to surround the rear part of the frame 304. A locking nut 359 is provided to one of the branch of the U-shaped element 344 to fasten it to the inner wall of the frame 304. Advantageously, elements of the fastening means 230 of the second embodiment may be used as parts of the fastening means of the third embodiment. Once the jaw bolts or pivots 241 are removed, the first jaw 24 239 may be fastened to the second jaw 239 by a locking nut 210 (see FIG. 15), thereby defining the U-shaped member 344. A locking nut 359, which is advantageously the same than the locking nut 245, is provided to the screw holes 272 and fasten the supporting element 10 to the inner wall of the frame 304.

As it clearly appear from the drawings, this third fastening means may be constructed by putting together in a different way the supporting member 10, the jaw 237 and the locking nut 245 of the fastening means of the second embodiment. Such a versatility of the fastening means of the device 1 is particularly useful as it allows for a greater adaptability to various kinds of drawing boards.

Therefore, by addition of some additional elements and by providing of corresponding screw holes in a same supporting member 10, the device 1 of the first embodiment may be fastened to a great range of working surfaces such as architect's drafting boards, or illustrator, designer and artist canvases.

The different parts of the device may be built in any convenient material such as long-lasting hard wood, rigid plastic or metal, by known methods like cutting, moulding, etc.

The location of a vanishing point of a drawing or a picture is performed by positioning the stick 7 so that its pin 9 is where should be the vanishing point. When the vanishing point is located "off-board" it is first necessary to locate the horizon line at the eye level on the image. Of course it is assumed that the user has a proper knowledge of the notions of perspective drawings. Then, with the assistance of the rule 95 (see FIG. 3), the mounting of the horizon line is extended off the working surface 3 in the direction of the vanishing point to be pinpointed. After this, it is necessary to track down two of the most apparent converging lines of the drawing, which belong to the same parallel geometry, and to place the rule 95 on those lines of the drawing. In this case, the rule 95 has to be long enough to meet the horizon line. After the stick 7 is positioned with its pin 9 at the location where the rule 95 and the horizon line meets. At this stage, the set screw 53 is activated to lock the stick 7 in this position and the rule 95 may be removed.

Before removal of the stick 7, a reference mark has to be done on it so as to mark out the length portion of the stick 7 between the means for removably positioning and locking the stick 50 and the pin 7. Such landmark may be made by positioning a removable sticker or by drawing a line 80 with a pencil as shown on FIG. 3. Then, the stick 7 may be removed. Care has to be done by the user not to move the abutment element 63. The user is now free to work on the drawing.

When the vanishing point is needed for completion, revision or modification of the drawing, the stick has simply to be set in the supporting and locking means in a position given by the abutment 53 which give the direction, and the line 80 which give the correct length of the stick.

When the slot 57 of the sliding support arm 55 is completely engaged by the set screw 59, another and more convenient way to remove the stick 7 is to unscrew the screw 59 and then remove from the supporting member 10 the whole assembly constituted by the sliding support arm 55, the abutment element 63 and the stick 7. It is easy to understand that these elements must stay positioned and attached together and their spatial relationship between them must be preserved. When the vanishing point is needed, this assembly, comprising the support arm 55, the abutment element 63 and the stick 7, is simply reset on the supporting member 10 by engaging completely the slot 57 and then rescrewing the set screw 59.

The device 1 may also be removed from the support 3. In this case, it is important to provide reference marks allowing the relocation of the device 1 on the drawing board or frame in the very same position in the same way as for the removal of the stick 7.

The device according to the invention may then be dismantled and easy handled for travelling with the instrument to work outside.

Although the present invention has been herein above explained and described by way of the most preferred embodiments thereof, it is apparent that modifications and changes may be made therein without departing from the invention as described in the appended claims.

I claim:

1. A portable and removable device for positioning and resetting a vanishing point of a perspective drawing which is to be construed on a support, said device comprising:

at least one stick of a given length and having opposite ends, one of these ends being provided with a transversal pin; and a supporting member having in combination:

means for removably fastening said member on the supports, said means having lateral sides; and means for releasably positioning and locking the stick to the member, the pin at the one end of said stick being positioned at a given distance from the member and used to locate the vanishing point, said means for releasably positioning and locking said stick comprising an adjustable abutment adapted to position said stick in a given direction, said abutment being able to remain in such an orientation after removal of the stick and the means for releasably positioning and locking so as to reset the given direction of the stick; and spacing means for modifying the distance of the stick from the support where the drawing is construed.

2. The device of claim 1, wherein the spacing means comprises a slanted wheel, said wheel being positioned under the stick to give to said stick a given angle with respect to the support, said spacing means being removably fastened in a given position by said means for releasably positioning and locking.

3. The device of claim 1, further comprising:

a second stick; and second means for pivotally positioning and locking said second stick and spacing means for modifying the distance of the second stick from the support where the drawing is construed, one of the positioning and locking means being provided on each side of the means for removably fastening the member on the support.

4. The device of claim 1, wherein the means for positioning and locking the stick comprises an element provided with a guiding groove for receiving said stick, said guiding groove defining the abutment, said element being provided with a locking vice to fasten said element in a given position.

5. The device of claim 1, wherein the fastening means comprising a pair of jaws to grasp the support, said pair of jaws being mounted on the support member by at least one setscrew.

6. The device of claim 1, further comprising a rule with an eyehole mounted by means of said eyehole on the pin of the stick.

* * * * *